US006647602B2

(12) United States Patent
Bachofner et al.

(10) Patent No.: US 6,647,602 B2
(45) Date of Patent: Nov. 18, 2003

(54) FIXATION DEVICE FOR BLADING OF A TURBO-MACHINE

(75) Inventors: René Bachofner, Neuenhof (CH); Wolfgang Kappis, Mellingen (CH); Pavel Rihak, Baden (CH); Ferdinand Thueringer, Wettingen (CH); Ulrich Waltke, Muelheim an der Ruhr (DE); Hans Wettstein, Fislisbach (CH)

(73) Assignee: Alstom (Switzerland) Ltd, Baden (CH)

( * ) Notice: Subject to any disclaimer, the term of this patent is extended or adjusted under 35 U.S.C. 154(b) by 18 days.

(21) Appl. No.: 09/996,683

(22) Filed: Nov. 30, 2001

(65) Prior Publication Data

US 2002/0127105 A1 Sep. 12, 2002

(30) Foreign Application Priority Data

Dec. 16, 2000 (DE) ..... 100 62 908

(51) Int. Cl.[7] ..... B23P 15/00
(52) U.S. Cl. ..... 29/23.51; 29/889.21; 29/889.22
(58) Field of Search ..... 416/221, 215, 416/219 R; 415/209.3, 198 R; 29/23.51, 889.21, 889.22

(56) References Cited

U.S. PATENT DOCUMENTS 3,721,506 A * 3/1973 Anderson ..... 416/215
5,961,286 A * 10/1999 Schaub et al. ..... 415/209.3
6,126,357 A * 10/2000 Alkelin et al. ..... 403/28
6,439,841 B1 * 8/2002 Bosel ..... 415/142
6,517,313 B2 * 2/2003 Rogers ..... 415/137
2003/0002987 A1 * 1/2003 Davidson ..... 416/198 A
2003/0012654 A1 * 1/2003 Strassberger et al. ... 416/219 R

* cited by examiner

*Primary Examiner*—I Cuda-Rosenbaum
(74) *Attorney, Agent, or Firm*—Burns, Doane, Swecker & Mathis, L.L.P.

(57) ABSTRACT

Described is a fixation device for blading of a turbo-machine, in which, longitudinally to a mounting groove (1), a plurality of blades (31, 32) is positioned, and in which, between at least two blades (31, 32) positioned adjacent to each other inside the mounting groove (1), a mounting gap is provided, having two insertion elements constructed as collar halves (41, 42) that can be inserted into the mounting gap, and each of which has a width adapted to the width of the mounting gap and which enclose between themselves a gap space (5) into which a wedge element (43) can be inserted that can be wedged in such a way that both collar halves (41, 42) are fixed in a force-derived manner by means of the wedge element (43) inside the mounting groove (1). The invention is characterized in that the wedge element (43) is provided with at least one connecting element (45) towards the side of a blade (31, 32) and that at least one of the two blades (31, 32) adjoining the wedge element (43) is provided with a counter-contour (46) corresponding to the connecting element (45), so that the wedge element (43) and the blade enter (31, 32) into an intimate shape-mated connection with each other.

9 Claims, 2 Drawing Sheets

FIXATION DEVICE FOR BLADING OF A TURBO-MACHINE

CROSS-REFERENCE TO RELATED APPLICATIONS

Figure 1A:
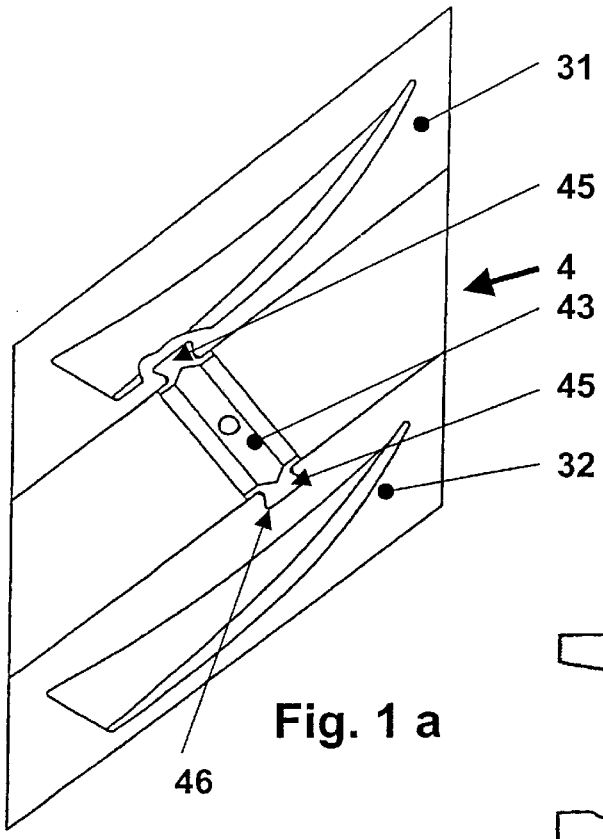

This application is a continuation of and claims priority under 35 U.S.C. §119 and/or 365 to 10062908.3 filed in Germany on Dec. 16, 2000.

FIELD OF TECHNOLOGY

The invention relates to a fixation device for blading of a turbo-machine, in which, longitudinally to a mounting groove, a plurality of blades is positioned and in which, between at least two blades positioned adjacent to each other inside the mounting groove, a mounting gap is provided, having two insertion elements constructed as collar halves that can be inserted into the mounting gap, and each of which has a width adapted to the width of the mounting gap and which enclose between themselves a gap space into which a wedge element can be inserted that can be wedged in such a way that both collar halves are fixed in a force-derived manner by means of the wedge element inside the mounting groove.

STATE OF THE ART

Bladings of the previously described type are related to guide blades, but in particular to rotating blades inside turbo-machines, such as, for example, the compressor or turbine stage of a gas turbine system. The following explanations relate preferably to rotating blades provided longitudinally to a mounting groove provided inside the rotor of a turbo-machine and extends around it along its circumference, and which rotating blades must be positioned in a suitable manner with respect to the respective flow conditions and must be reliably secured against potential maladjustments during the operation of the turbo-machines, but in particular against a complete detachment from the mounting groove. The measures to be instituted with respect to the rotating blades, as described below, can also be used, however, for the guide blades integrated in the stationary housing components of turbo-machines.

The risk of a complete detachment of individual rotating blades from the respective mounting means exists if the rotating blades inserted inside the mounting grooves and attached in an actually known manner are able to move unevenly within the respective mounting play circumferentially along the mounting groove on the rotor. Such peripheral maladjustments in a plurality of rotating blades inserted along the mounting groove may result in a significant gap being created between two adjoining rotating blades, said gap being large enough so that a rotating blade is able to detach itself by radial twisting from the mounting groove, resulting in substantial damage to the entire turbo-machine system.

In general, actually known means for securing against an autonomous detachment of individual rotating blades from the mounting groove relate to the reduction of the play in circumferential direction between two adjacent blade roots within the mounting groove. After installing all rotating blades inserted into the mounting groove, as well as all whole and halved intermediate pieces, a gap is created between, for example, two adjacent rotating blades facing each other inside the mounting groove, this gap being the so-called mounting gap, into which is inserted a so-called rotor collar that ensures that the play between the rotating blades set into the mounting groove and between the intermediate pieces is minimized.

Figure 2A:
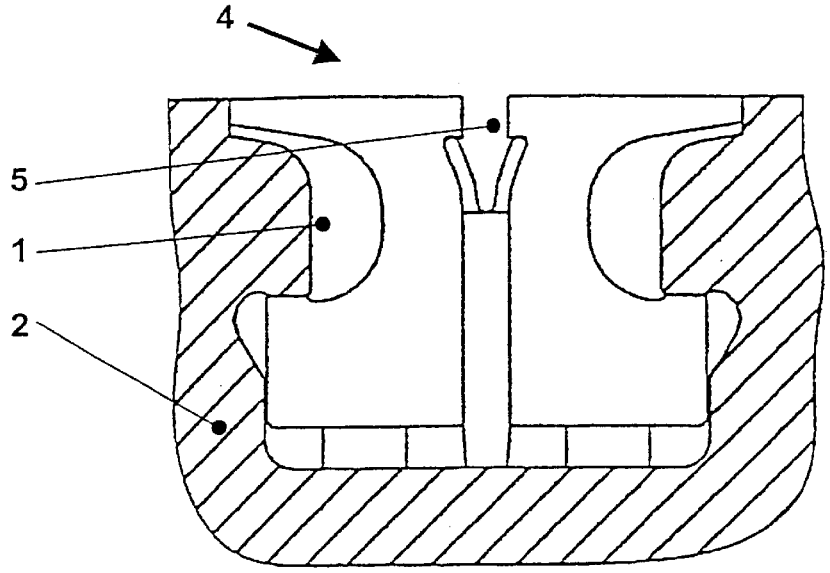
Fig. 2a PRIOR ART

An actually known rotor collar is described below in reference to FIGS. 2*a*–2*c*. FIG. 2*a* shows a cross-section through a mounting groove 1 fabricated within a rotor 2. With respect to the mutual attachment of two rotating blades 31, 32 positioned immediately adjacent to each other within the mounting groove 1 (see top view according to FIG. 2*c*), the so-called rotor collar 4 is inserted radially between the two blades 31, 32 in the mounting groove 1. As illustrated in detail in FIG. 2*b*, the rotor collar 4 consists of two so-called collar halves 41, 42 as well as a wedge element 43. The sides of the collar halves 41, 42, which each face towards the mounting groove 1, are appropriately designed for a force-derived and shape-mated engagement with the internal contour of the mounting groove 1. In the inserted condition within the mounting groove 1, both collar halves 41, 42 enclose a gap 5, into which the wedge element 43 can be inserted in a radial direction. In the top portion, the collar halves 41, 42 have a corresponding recess 6 (see FIG. 2*b*), each of which is similar to the shape of half a heart, in which the retention tabs 44 of the wedge element 43 are permanently spread according to the illustration in FIG. 2*a*, in order to permanently spread both collar halves 41, 42 against the inside contour of the mounting groove 1.

Because of the different thermal expansion behaviors between the blades, the rotor collar, and the rotor, a play is created during operation between the blades and the intermediate pieces inside the mounting groove, including the rotor collar. Because of the resulting circumferential play, the collar halves may shift in relation to one another in a circumferential direction along the mounting groove so that the spread wedge element is able to detach itself from the heart-shaped recesses. Such a case would again result in the initially described damage scenario.

DESCRIPTION OF THE INVENTION

Figure 2B:
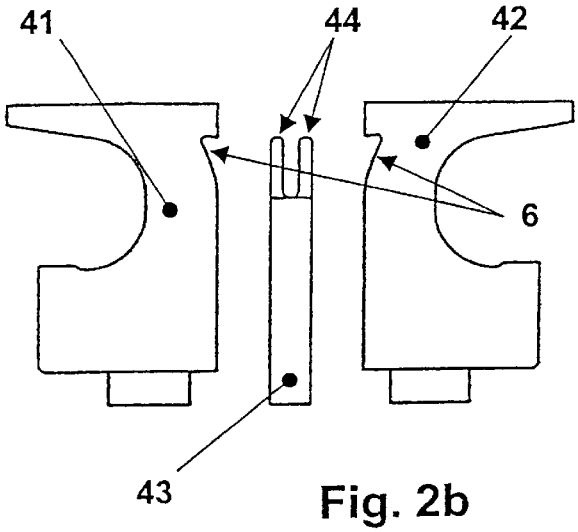
Fig. 2b PRIOR ART
Figure 2C:
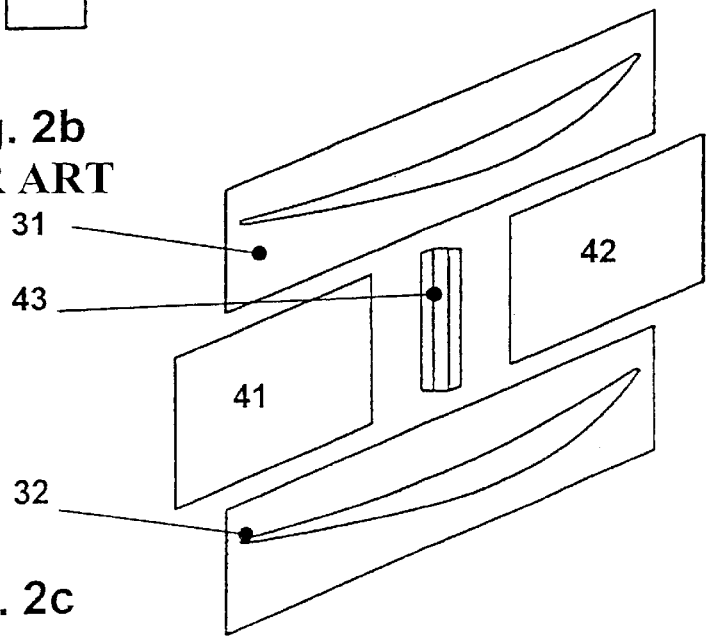
Fig. 2c PRIOR ART

The objective therefore is to further develop a fixation device of this type, as illustrated, for example, in FIGS. 2*a*–2*c*, in such a way that the previously described damage scenario can be excluded. The respective measures should be as simple as possible in their construction and should be economical to realize.

The realization of the objective of the invention is disclosed in claim 1. Characteristics that advantageously further develop the concept of the invention are the subject of the secondary claims and in particular of the specification, in reference to the figures.

According to the invention, a fixation device according to the preamble of claim 1, for example a fixation device of this type as referenced in FIGS. 2*a*–2*c*, is constructed in such a way that the wedge element is provided with at least one connecting element towards the side of a blade and that at least one of the two blades adjoining the wedge element is provided with a counter-contour corresponding to the connecting element, so that the wedge element and the blade enter into an intimate shape-mated connection with each other.

The idea on which the invention is based is the creation of an intimate shape-mated connection between the wedge element and at least one immediately adjacent rotating blade, so that no relative movements between the rotating blade and the wedge element and, related to this, the entire rotor collar are able to occur, so that the initially described risk potential with respect to the detachment of the wedge element can be decisively limited.

In an especially advantageous manner, the wedge element is connected with the two immediately adjacent blades via respective shape-mating connecting elements. Such a design of a fixation device according to the invention is explained below in reference to the figures.

BRIEF DESCRIPTION OF INVENTION

Figure 1C:
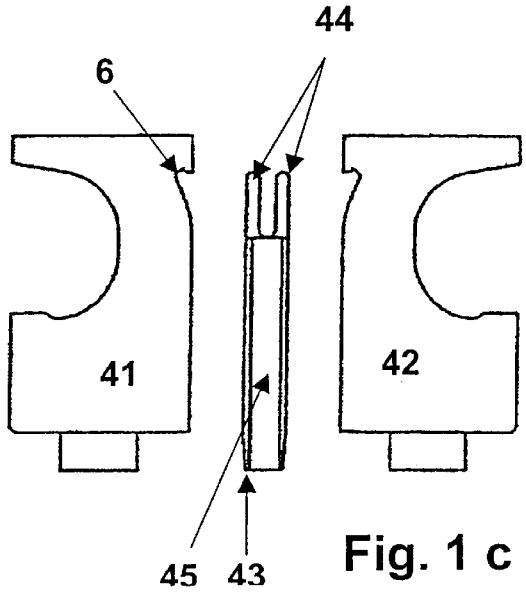
Figure 1B:
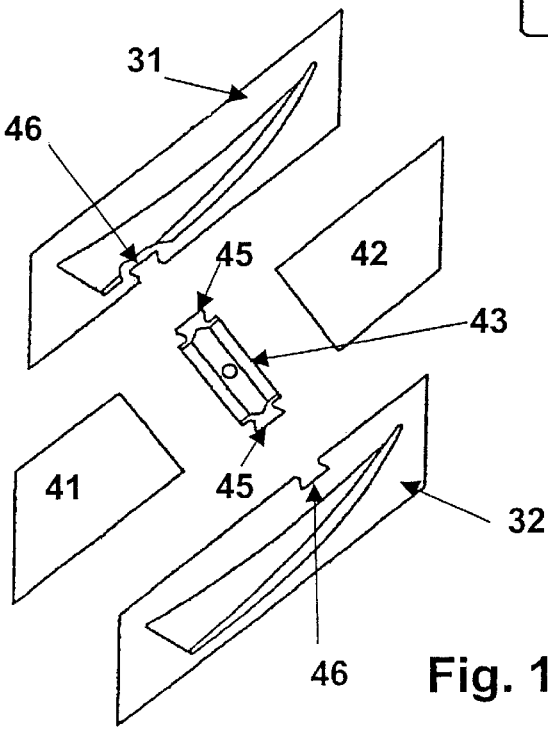

The invention is described below as an example, using exemplary embodiments in reference to the drawings without limiting the general idea of the invention. Hereby:

FIG. 1*a* shows a top view of a rotor collar according to the invention in connection with two adjacent blades, FIG. 1*b* shows a top view of an individual component illustration of the components as illustrated in FIG. 1*a,*

FIG. 1*c* shows a side view of the rotor collar constructed according to the invention, FIGS. 2*a–c* show illustrations of an actually known rotor collar (state of the art).

WAYS OF EXECUTING THE INVENTION, COMMERCIAL USABILITY

FIG. 1*a* shows a top view onto a complex consisting of two rotating blades 31, 32 inserted within a mounting groove (not shown) and a rotor collar 4 between the rotating blades 31, 32. The rotor collar 4 has a wedge element 43 that has on its sides facing the rotating blades 31, 32 one each connecting element 45 that is constructed as a dovetail, each of which engages by way of a force derived or shape-mated connection with a counter-contour 46 worked within the rotating blades 31, 32.

As a result of the mechanical connection positioned according to the invention between the rotor collar 4 and the two rotating blades 31, 32, relative movements caused by different thermal expansion phenomena can be excluded, so that no impermissible gap is able to form along the mounting groove, which gap would result in the risk of a detachment of parts located inside the mounting groove.

The individual component illustration according to FIG. 1*b* clearly shows the counter-contours 46 inside the rotating blades 31, 32. For the mounting of the rotor collar 4 constructed according to the invention, first the collar halves 41, 42 are inserted in radial direction into the gap between the rotating blades 31, 32 in the mounting groove. Then, the wedge element 43 constructed according to the invention is also radially inserted both into the gap between the two collar halves 41, 42 as well as radially inside the rotating blades' 31, 32 counter-contours 46 facing each other. This causes the two adjacent rotating blades 31, 32 to be mechanically connected with each other via the wedge element 43. If the wedge element 43 is sunk completely between the collar halves 41, 42, the retention tabs 44 of the wedge element 43 are pressed by means of a suitable tool into the heart-shaped recesses 6.

In addition to the construction of the connecting element 45 as a dovetail, alternative connection profiles are also principally conceivable, for example, hammer profiles of all types as well as Christmas tree profiles. It is preferred that the counter-contour 46 is placed inside the blade root of the individual rotating blades 31, 32. The counter-contour 46 need not necessarily extend over the entire depth of the blade root.

FIG. 1*c* shows a lateral view of the rotor collar 4 constructed according to the invention. In contrast to the illustration according to FIG. 2*b*, the wedge element 43 is provided with the connecting element 45, which according to the invention is constructed as a dovetail, which extends according to the embodiment in FIG. 1*c* over the entire length of the blade root. As in the case of FIG. 2*b*, the wedge element 43 has two retention tabs 44 that engage with the corresponding recess 6 inside the rotating blades 41, 42.

It is also conceivable that further connecting elements be provided between the individual collar halves 41, 42 and the rotating blades 31, 32 immediately adjoining them. In this manner, a further improved, mechanically intimate connection can be achieved between the rotor collar constructed according to the invention and the adjacent rotating blades.

Connecting elements according to the invention can also be installed at a different place in the same blade row.

List of reference numerals

1 Mounting groove
2 Rotor
31, 32 Blades
4 rotor collar
41, 42 Collar halves
43 Wedge element
44 Retention tabs
45 Connecting element
46 Counter-contour
5 Gap
6 Recesses

What is claimed is:

1. A device for fixing blades in a turbo-machine, wherein a plurality of blades are inserted within a mounting groove, and a mounting gap is defined between at least two blades positioned adjacent to each other inside the mounting groove, the device comprising:

a wedge element;

two insertion elements constructed as collar halves that can be inserted into the mounting gap, each of the insertion elements having a shape for a shape-mated engagement with the adjacent two blades and the insertion elements enclosing between themselves a gap space when the insertion elements are inserted into the mounting gap such that the wedge element can be inserted into the gap space;

the wedge element being wedged in the gap space such that both collar halves are fixed in the mounting gap by the wedge element, the wedge element being provided with at least one connecting element on the wedge element facing towards the side of a blade and the corresponding blade being provided with at least one mating recess corresponding to the at least one connecting element, so that the wedge element and the blade are closely connected with each other by a shape-mated connection.

2. The device for fixing blades according to claim 1, wherein the at least one connecting element and the at least one corresponding mating recess are constructed as a dovetail connection.

3. The device for fixing blades according to claim 1, wherein the wedge element is provided on both sides with connecting elements for mating with both adjacent blades in order to produce a close connection.

4. The device for fixing blades according to claim 1, wherein the wedge element can be pushed in radially between both blades and between both collar halves, said wedge element being provided with retention tabs that can be permanently spread into corresponding recesses defined in the collar halves.

5. The device for fixing blades according to claim 1, wherein at least one connecting element and the at least one corresponding mating recess are constructed as a hammer profile or a Christmas tree shape.

6. The device for fixing blades according to claim 1, wherein the blades are rotating blades inside a rotor arrangement or guide blades inside a stator arrangement.

7. A device for fixing blades in a compressor unit or turbine stage in a gas turbine system, wherein a plurality of blades are inserted within a mounting groove, and a mounting gap is defined between at least two blades positioned adjacent to each other inside the mounting groove, the device comprising:

a wedge element;

two insertion elements constructed as collar halves that can be inserted into the mounting gap, each of the insertion elements having a shape for a shape-mated engagement with two adjacent blades and the insertion elements enclosing between themselves a gap space when the insertion elements are inserted into the mounting gap such that the wedge element can be inserted into the gap space;

the wedge element being wedged in the gap space such that both collar halves are fixed in the mounting gap by the wedge element, the wedge element being provided with at least one connecting element on the wedge element facing towards the side of a blade and the corresponding blade being provided with at least one mating recess corresponding to the at least one connecting element, so that the wedge element and the blade are closely connected with each other by a shape-mated connection, wherein the turbo-machine is a compressor unit or a turbine stage in a gas turbine system.

8. The device for fixing blades according to claim 1, wherein the blades are arranged in a row of blades and at least one shape-mated connection is provided in the row of blades between the wedge element and a blade.

9. The device for fixing blades according to claim 1, wherein the blades of a row of blades are fixed in a mounting groove.

* * * * *